United States Patent [19]

Huebner et al.

[11] Patent Number: 4,978,077

[45] Date of Patent: Dec. 18, 1990

[54] APPARATUS AND PROCESS FOR SEPARATING BONE FRAGMENTS, GRISTLE AND SINEWS FROM MEAT AS THE MEAT IS BEING GROUND

[75] Inventors: Patrick H. Huebner, Le Mars; Joseph G. Sebranek; Dennis G. Olson, both of Ames, all of Iowa; Eugene A. Anderson, College Park, Ga.

[73] Assignee: Iowa State University Research Foundation, Inc., Ames, Iowa

[21] Appl. No.: 459,437

[22] Filed: Jan. 2, 1990

Related U.S. Application Data

[63] Continuation of Ser. No. 258,169, Oct. 14, 1988, Pat. No. 4,928,892.

[51] Int. Cl.[5] ..... B02C 18/36

[52] U.S. Cl. ..... 241/30

[58] Field of Search ..... 241/82.1–82.5, 241/260.1, 30

[56] References Cited

U.S. PATENT DOCUMENTS

| | | | |
|---|---|---|---|
| 3,847,360 | 11/1974 | Seydelmann . | |
| 3,934,827 | 1/1976 | Seydelmann . | |
| 4,004,742 | 1/1977 | Hess . | |
| 4,153,208 | 5/1979 | Vomhof et al. . | |
| 4,202,502 | 5/1980 | Laska . | |
| 4,253,615 | 3/1981 | Koenig | 241/260.1 X |
| 4,315,604 | 2/1982 | Meyenschein | 241/82.5 |
| 4,358,061 | 11/1982 | Richter . | |
| 4,422,582 | 12/1983 | Roeger et al. . | |
| 4,699,325 | 10/1987 | Hess . | |
| 4,852,817 | 8/1989 | Tipton | 241/260.1 |

*Primary Examiner*—Mark Rosenbaum

*Attorney, Agent, or Firm*—Hurt, Richardson, Garner, Todd & Cadenhead

[57] ABSTRACT

A conventional meat grinder contains a chopper knife and a chopper plate, the chopper knife rides on the inner surface of the chopper plate and directs the bone fragments, sinews and gristle inwardly toward the central portion of the chopper plate as it chops the meat. The central portion of the chopper plate has a funnel-shaped, frusto-conical central passageway within which the bone fragments, gristle and sinews and collected and are urged outward, first passing through the frusto-conical passageway and out the small end of the passageway, into opposed discharge channels which passes through the hub of the plate and communicates with a discharge tube whose distal end is closed or partially closed by a removeable stopper or adjustable clamp.

9 Claims, 5 Drawing Sheets

APPARATUS AND PROCESS FOR SEPARATING BONE FRAGMENTS, GRISTLE AND SINEWS FROM MEAT AS THE MEAT IS BEING GROUND

REFERENCE TO RELATED APPLICATION

This is a continuation of Application Ser. No. 258,169 filed Oct. 14, 1988, now U.S. Pat. No. 4,928,892.

BACKGROUND OF THE INVENTION

This invention relates to a meat grinder and is more particularly concerned with an apparatus and process for separating bone fragments, gristle and sinew from meat as the meat is ground.

DESCRIPTION OF THE PRIOR ART

Ground or comminuted meat has come to be a very popular food item in recent years as demonstrated by frequency of consumer use and the rapid development of fast food chains. Per capita consumption of hamburger in 1986 was over 29 lbs. It has also been estimated that over 8 billion pounds of ground beef is produced annually.

It is in the grinding of this meat that the problem of bone chips or fragments entering into the product occurs. It is estimated that 0.1% of all meat being ground is bone that was not removed at the trimming tables. Therefore, at grinding, the bone chips that are larger than the final grind size will ride on the knife-plate interface with subsequent shearing of the bone and passage through the plate to the final product.

Since the development of meat grinders, a need has existed for an efficient and reliable way to separate the bone fragments, gristle and sinews (hard material) from the meat as the meat is ground or chopped by the meat grinder.

In the prior art there are a number of patents which attempt to remove the hard material, i.e., bone fragments, gristle and sinews, from meat in a meat grinder or chopper. For example Roeger et al. U.S. Pat. No. 4,422,582 , teaches a food processing machine in which the blades direct the hard material toward the radially outer peripheral region of the chopper plate or grinding plate where the hard material is removed. Vomhof et al. U.S. Pat. No. 4,153,208, discloses a similar device in that the hard particles are discharged through an annular channel surrounding the chopper plate.

Hess U.S. Pat. No. 4,699,325, rather than discharging the bone chips outwardly, uses a tangential groove in the inner surface of a chopper plate to direct the hard material into a central cylindrical pocket, which has a flat bottom, where the hard material, thence is progressively moved through a single, smaller, asymmetrically positioned, discharge passageway, adjacent to the shaft of the auger. This Hess patent does teach that the small holes through which the meat is forced can be frusto-conically shaped, and states that such holes should widen in a downstream direction. This patent also shows a hub with a tube through which the bone is discharged separately from the ground meat. A second Hess Patent No. 4,004,742 discloses an involute spiral channel in the grinder plate, through which bone fragments are swept to the center of a grinder plate for removal.

Richter U.S. Pat. No. 4,358,061 discloses the use of three discharge passageways, radially spaced around the hub of the meat chopper and a rotatable pipe piece which can adjust the size of the passageways. This patent also discloses a cutting blade which directs the bone chips inwardly toward the hub of the perforated disc chopper plate.

Seydelmann U.S. Pat. No. 3,847,360 discloses the use of a hollow groove in the blade of the chopper for directing the bone and gristle toward the hub of the chopper plate.

Laska U.S. Pat. No. 4,202,502 discloses a central passage in a chopper plate formed by flattened shaft of the auger received in the passage, the rejected hard and tough portions being discharged through this passage along the flattened sides of the shaft to an hub and, thence, to a discharge tube. Grooves in the blades direct the rejected material toward the passage.

U.S. Pat. No. 3,934,827 discloses a chopper plate or die with arcuate grooves for the bone chips, these grooves being progressively shallower as they feed toward the central part of the plate and communicate with the through-going holes in the central part of the chopper plate.

All of these central bone removal systems rely on the meat as a carrier for the bone fragments and connective tissue to the exterior where they can be discharged. However, red meat loss must be minimized. The prior art patents also recognize that it is necessary to provide an adequate back pressure on the accumulated bone, gristle and sinews (hard material) to prevent the discharge of appreciable meat; however, this back pressure was achieved by providing tortuous paths through which the material traveled. In such prior art structures, the internal, forward pressure on the meat provided little force on the hard material for urging this material to change course from a central cup to pass through the relatively small central exit openings.

BRIEF SUMMARY OF THE INVENTION

Briefly described, the present invention, which efficiently removes the bone fragments, sinews and gristle, includes the usual meat grinder in which a helix or auger feeds the meat toward the chopper plate and a rotatable knife, chops or cutting the meat, as it is urged against the inner surface of the chopper plate and through the small holes of the body of the chopper plate. In the present invention the chopper plate is provided with a large frusto-conical, central, bone accumulating and discharging passageway which is defined by a symmetrically, uniformly, radially outwardly tapering, or converging surface, which in one embodiment, communicates with the inner ends of a pair of diametrically opposed, curvilinear, generally crescent shaped, discharge ports on the opposite sides of the central stub shaft of the auger. In a second embodiment, the bone discharging passageway is frusto-conical in shape throughout substantially its entire length tapering to a discharge port area in which three, thin equally circumferentially spaced struts support a central journal for the stub shaft of the auger.

In each embodiment the chopper plate is provided with an outwardly protruding central hub which, together with the central portion of the chopper plate defines the outer portion of the bone discharging passageway, the protruding hub terminating in an enlarged circumferential shoulder, over which is received at one end of a flexible bone discharge tube, the other end of which removably receives a conventional cork or stopper. The inner end portion of the discharge tube is retained in place by a clamp and an adjustable clamp, near the discharge end of the tube, deforms the tube to regulate the effective size of the tube.

The chopper blade has a body with a central hub having an axial shaft receiving opening which is square (non-circular) and is received on the square blade driving block between the stub shaft and the termination of the auger. The hub of the chopper blade is sufficiently wide that it covers a substantial part of the intake end of the bone discharging passageway. Knives, which protrude forwardly from the arms of the blade and engage the surface of the chopper plate, are each generally triangular in cross-section and having a forward or front surface terminating in a common plane with the front portion of the arm. The inner ends of each knife terminates outwardly of the blade hub so that the inner ends of the knives are radially outwardly of the intake mouth of the bone discharge passageway. Each of the knives is disposed at a slight acute angle to the radius of the blade so as to direct the hard material inwardly as the blade rotates about the axis of the meat grinder.

Accordingly, it is an object of the present invention to provide a meat grinder assembly which is inexpensive to manufacture, durable in structure and efficient in operation.

Another object of the present invention is to provide an apparatus and process for removing bone from meat as it is ground so as to reduce to a minimum loss of the meat in the separated bone.

Another object of the present invention is to provide a meat grinder assembly which will effectively separate the hard particles, such as bone fragments, gristle and sinews from the meat which is being ground and feed these hard particles along a separate passageway for discharge from the central portion of the chopper plate.

Another object of the present invention is to provide a blade and chopper plate assembly for an otherwise conventional meat grinder which will convert the conventional meat grinder into an efficient apparatus for separating the bone particles, gristle and sinews from the ground meat.

Another object of the present invention is to provide a chopper plate for a meat grinder, the chopper plate being inexpensive to manufacture, and being well-suited for separating the bone, gristle and sinews from the meat as the meat is being ground.

Another object of the present invention is to provide a chopper plate for a meat grinder the chopper plate for efficiently separating the bone, gristle and sinews from the meat, as the meat grinder is operated.

Another object of the present invention is to provide a process for separating meat, gristle and sinews from meat being ground, and for efficiently removing the bone fragments, gristle and sinews from the ground meat.

Other objects, features and advantages of the present invention will become apparent from the following description when taken in conjunction with the accompanying drawings wherein like characters of reference designate corresponding parts throughout the several views.

DETAILED DESCRIPTION

Figure 1:
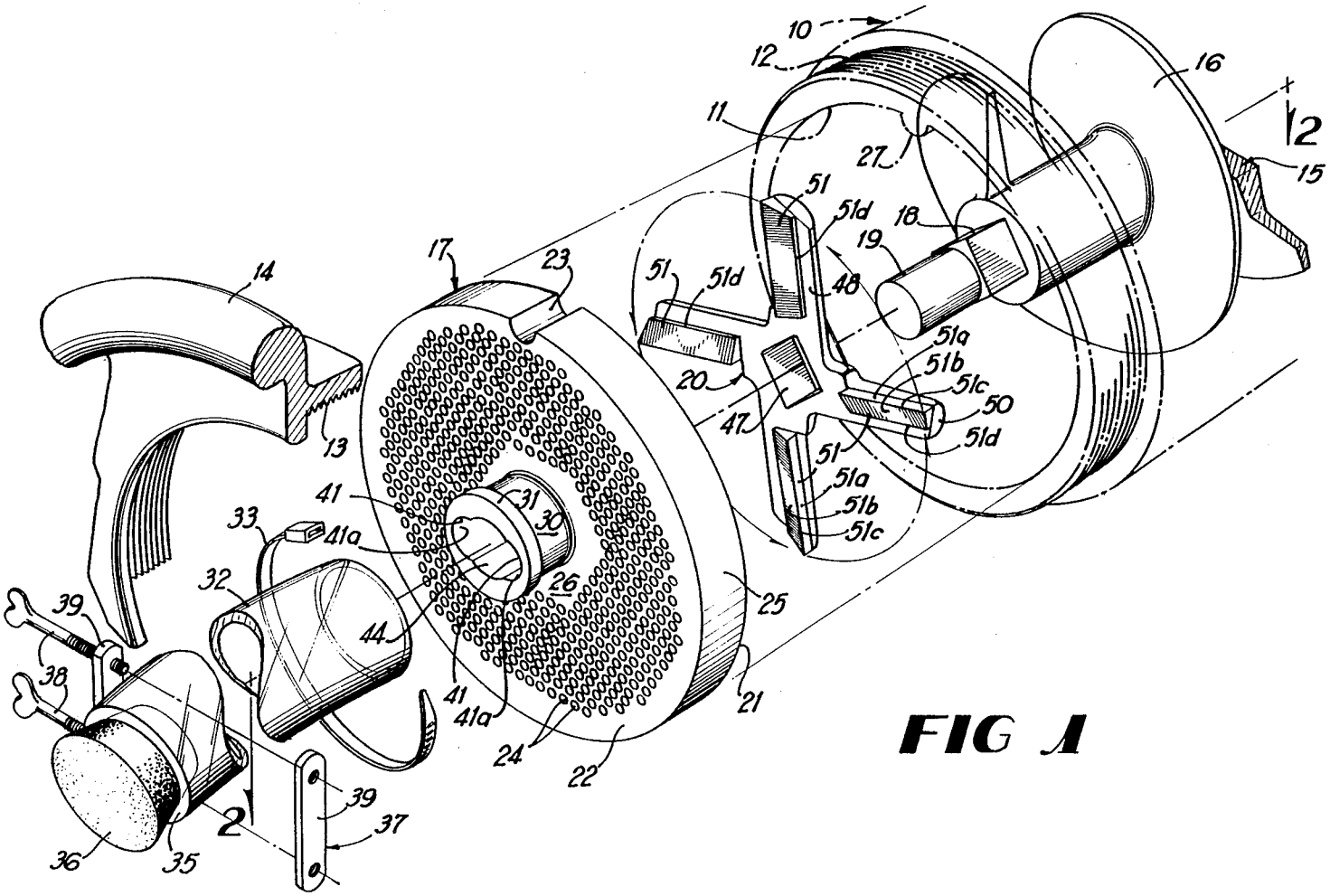
FIG. 1 is a fragmentary exploded perspective view of a portion of a meat grinder, the meat grinder having a chopper blade, a chopper plate and discharge tube assembly constructed in accordance with the present invention.
Figure 2:
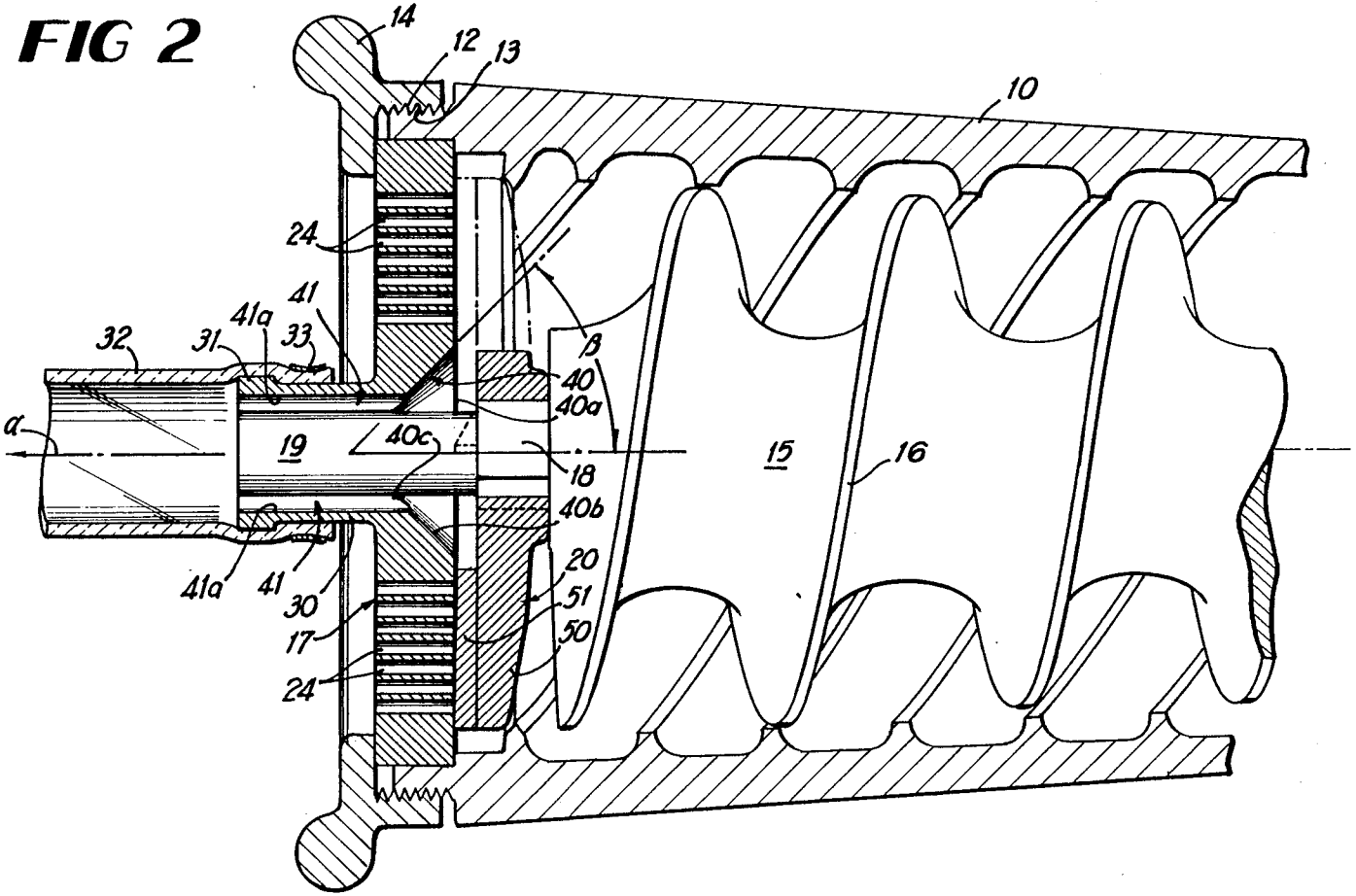
FIG. 2 is a front elevational view of the chopper plate of the meat grinder shown in FIG. 1 and showing the chopper blade in broken lines.
Figure 3:
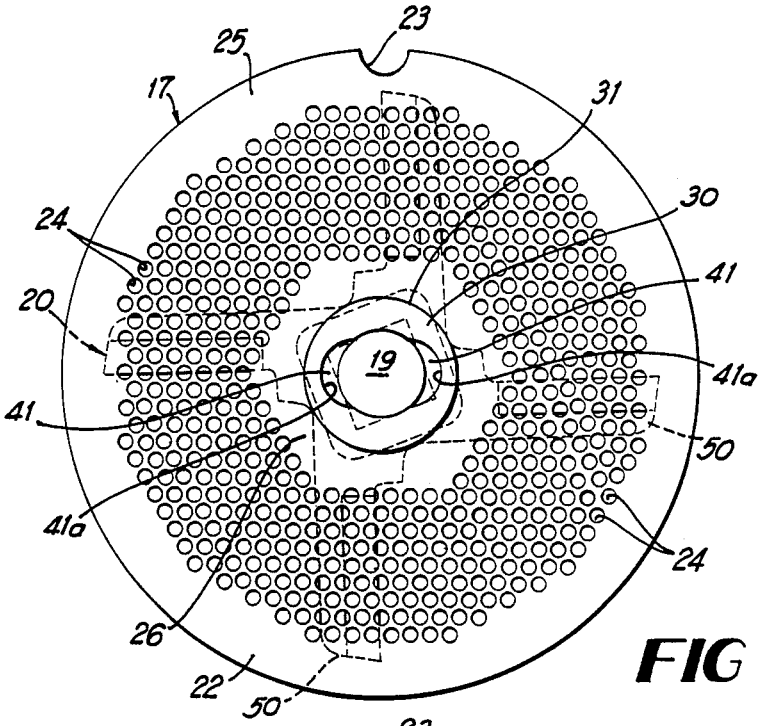
FIG. 3 is a rear elevational view of the chopper blade and chopper plate depicted in FIG. 2.
Figure 4:
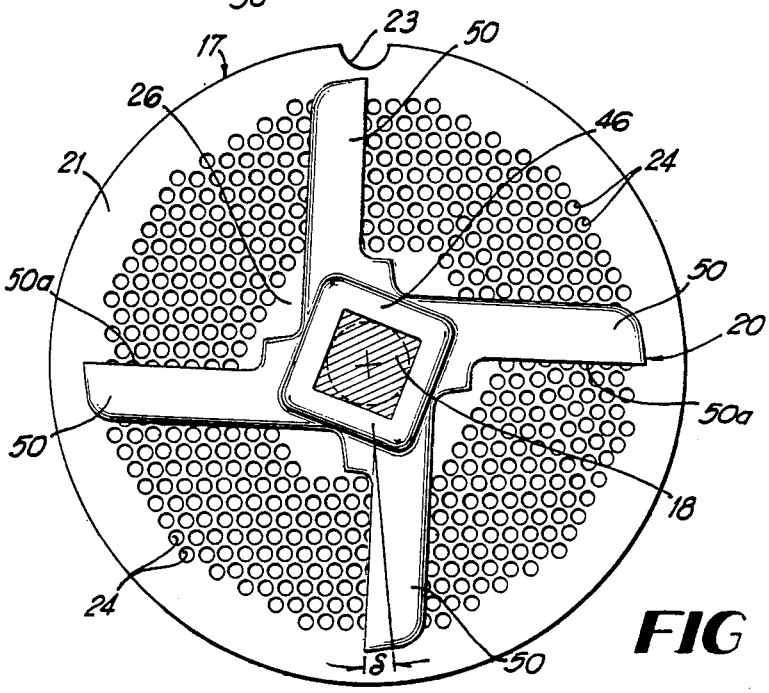
FIG. 4 is an enlarged vertical sectional view taken substantially along line 4—4 in FIG. 3.
Figure 5:
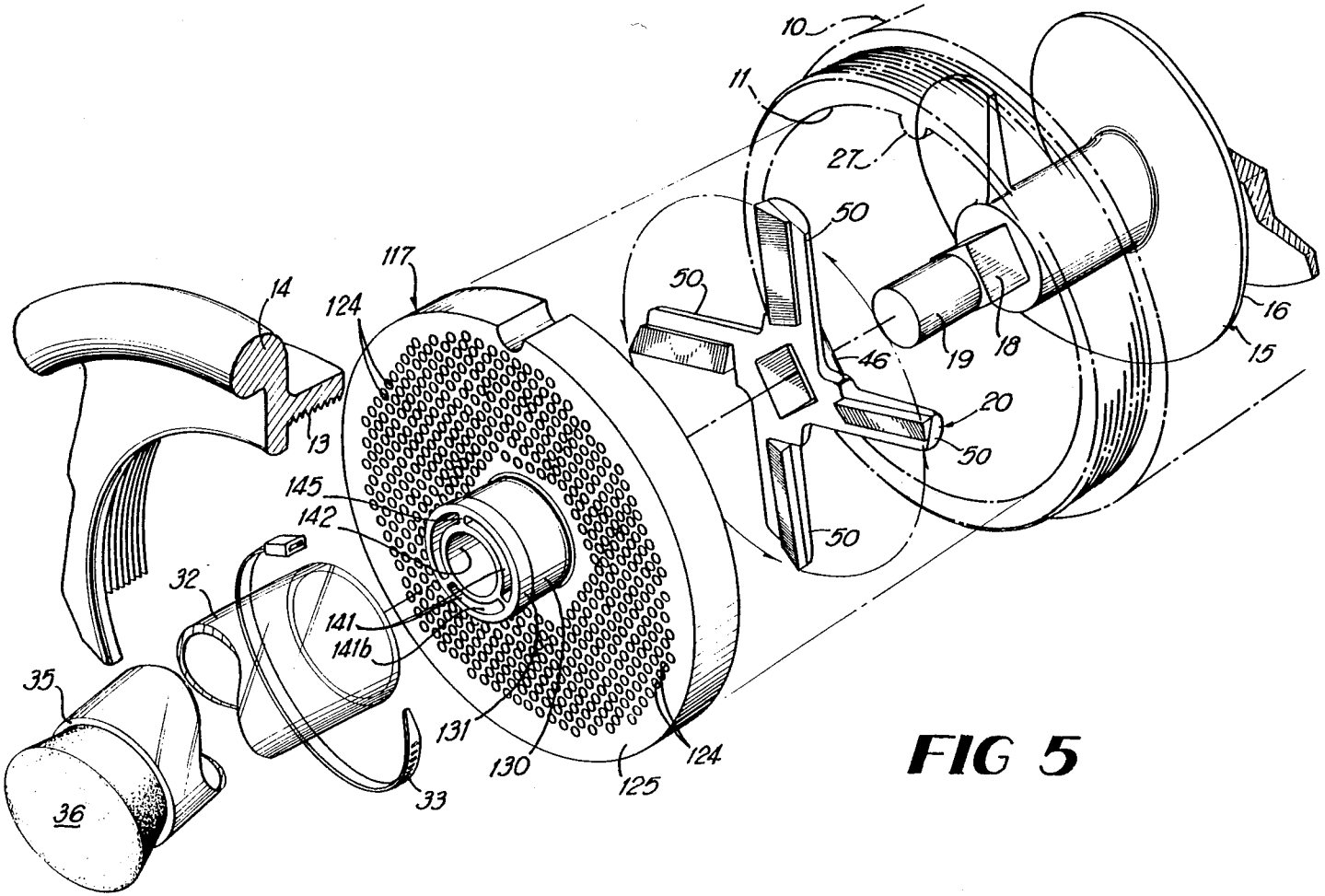
FIG. 5 is a fragmentary rear elevational view of the central portion of the chopper plate of FIGS. 1–4.

Referring now in detail to the embodiments chosen for the purpose of illustrating the present invention, numeral 10 in FIG. 1 denotes generally the tubular body of a conventional meat grinder this body 10 terminating in an annular chopper plate receiving end portion 11 provided with external threads 12 which receive the internal threads 13 of a retaining ring 14.

Within the central cavity of the meat grinder body 10 is the usual auger 15 having a helical blade 16 which sweeps along the inner periphery of the body 10 so as to feed the meat which is to be ground forwardly toward a chopper plate, denoted generally by the numeral 17. At the end of the blade 16, there is the usual square blade retaining block 18 and the stub shaft 19 which protrudes axially from the blade retaining block 18. A chopper blade, denoted generally by the numeral 20, is removably received on the blade retaining block 18 and the chopper plate 17 is fitted over and journals the stub shaft 19, the chopper plate 17 being urged against the chopper blade 20 by the retaining ring 14 when the retaining ring 14 is tightened onto the housing 10.

The chopper plate 17 is a disk-shaped annular plate having a flat inner surface 21 and flat outer surface 22. The periphery of the chopper plate 17 has the usual keyway 23 which receives the key 27 on the inner periphery of the end portion 11, when the chopper plate 17 is appropriately mounted, therein. The chopper plate 17 is provided with a plurality of meat extruding holes 24 arranged in parallel rows, each hole 24 extending from one surface 21 to the other surface 22 so as to provide a plurality of small passageways for the meat to pass, therethrough. The outer peripheral area of the chopper plate 17, however, is essentially solid so as to form an annular ring 25, against which the retaining ring 14 abuts.

The central portion 26 of the chopper plate 17 is larger than the central portion of a conventional chopper plate and is solid, having no meat extruding holes, such as holes 24. Protruding forwardly, i.e., outwardly from the central portion 26 is an axially protruding hub 30 which is integral with central portion 26 being cylindrical along its outer surface and terminating in a circumferential flange 31. The intake end of a flexible, plastic, discharge tube or hose 32 is fitted over the circumferential flange 31 so as to terminate on the hub 30 and adjacent to the outer surface of the central portion 26. A strap or clamp 33 extends around the end portion of the discharge tube 32 and around the hub 30 so as to retain the end portion of the flexible discharge tube 32 on the hub 30. The tube 32 extends an appreciable distance of usually about four feet (4') away from the hub 30 and terminates in an outer discharge end 35, into which is inserted a removable cork or stopper 36. Preferably the tube 32 is formed of clear plastic material so that the refuge, such as the bone chips or fragments, gristle and sinews may be observed as they pass through the tube 32.

A manually adjustable clamp 37, having set screws 38 passing through opposed clamp arms 39, fits over the tube 32 for regulating the back pressure when the stopper 36 is removed.

According to the present invention the central portion 26 of the chopper plate 17 and the hub 30 is provided with a frusto-conical or funnel shaped bone discharging passageway, denoted generally by the numeral 40. The mouth 40*a* of this passageway 40 is circular and concentric with the main axis $\alpha$ of the grinder while the inner surface or wall means 40*b* of the entrance portion of the discharge passageway 40 is a smooth, axially extending, generally uniformly tapering or converging, surface through a substantial portion of the thickness of the chopper plate 17 at central portion 26. Thence, surface 40*b* converges to a discharge end 40*c* and, then merges gradually into the spaced, opposed, concaved, semi-cylindrical exit defining surfaces 41*a* which define the radially outer extremities of a pair of axially extending, diametrically opposed, crescent shaped, discharge channels, or passages 41 on opposite sides of the stub shaft 19. These concaved exit surfaces 41*a* extend through a forward portion of central portion 26 and entirely through hub 30. The edges of surfaces 41*a* extend around spaced parallel axes on opposite sides of shaft 19 and circumferentially connect to the edges of diametrically opposed journalling surfaces 44 which are radially 90° from surfaces 41*a* and journal the stub shaft 19, when the meat grinder is assembled. The stub shaft 19 thus defines, with the surfaces 41*a* the pair of straight, crescent shaped, tubular, exit passages 41 the inner ends of which communicate with the discharge end or opening 40*c* of passageway 40.

In producing the bone discharging passageway 40 for the $5\frac{1}{4}$ inch, 6 inch or $8\frac{5}{8}$ inch diameter plate 17, the angle $\beta$ incline 8 between main axis $\alpha$ and the frusto-conical wall means or surface 40*b*, may vary from about 30° to about 55°. Preferably, the angle $\beta$ should be about 45°. The diameter of the throat, mouth or entrance 40*a* should be from about $1\frac{1}{4}$ inches to about $3\frac{1}{2}$ inches. Preferably, the throat, mouth or entrance 40*a* should be about 2 inches in diameter for the $5\frac{1}{4}$ inch or 6 inch plate 17. When the $8\frac{5}{8}$ inch plate 17 is used, the diameter of the throat 40*a* can be proportionally larger i.e., from about 2 inches to about $5\frac{3}{4}$ inches in diameter.

Each of the semi-cylindrical exit surfaces 41*a* of the $5\frac{1}{4}$ inch, 6 inch and $8\frac{5}{8}$ inch diameter plates 17 should have a diameter of from about 3/16 inch to about 7/16 inch and these surfaces 41*a* should be diametrically spaced apart by from about $\frac{7}{8}$ inch to about $1\frac{1}{4}$ inch. Preferably, however, the diameter of each surface 41*a* should be 5/16 inch. The surfaces 41*a* should be enlarged proportionally for larger plates 17. The diameter of the central opening, as defined by the opposed journalling surfaces 44 should be about 9/16 inch for the three size plates 17, discussed above. The frusto-conical passageway 40 should protrude at least half way through plate 17 while the discharge passage 41 should protrude entirely through hub 30.

The chopper blade 20 includes a central hub 46 provided with a square or rectangular (non-circular) central opening 47 of a shape to fit on blade receiving block 18 so that the blade 20 is rotated upon rotation of the auger 15. Protruding radially outwardly from the hub 46 are a plurality of equally spaced arms 50 which, in the present embodiment are disposed at 90° from each other, each arm 50 having a lower flat surface 48, which is in a common plane with the flat inner surface 49 of the hub 46. Each inner surface 48 of each arm 50 receives and retains in a fixed position, a knife 51 which is straight and generally triangular in cross-section, having a flat front surface 51*a* which is in a common plane with the flat front surface 50*a* of the arm 50. The front surfaces 50*a* and 51*a* are preferably perpendicular to surfaces 21 when the blade 20 is installed. Hence, the knife 51 can be ground by simply grinding this common front surface. Each knife 51 has a flat inclined rear surface 51*b* which converges toward edge 51*a*, terminating at a common straight cutting edge 51*c* with the front surface 51*a*. Each rear surface 51*b* diverges away from the interface of chopper plate surface 21 and cutting edges 51*c* and terminates in a straight back edge 51*d*.

The front surface 51*a* and cutting edge 51*c* of each knife 51 is disposed preferably at an angle $\delta$ of about 2° from the radius of the blade 20 so as to have the radially extreme portion of each knife 51 leading the inner portion of each knife 51, thereby providing a straight front surface which directs the hard material, such as the bone, gristle and sinews, inwardly as the blade 20 rotates. Since the common angle of the front surfaces 50*a* and 51*a* is perpendicular to plate surface 21 or is at a very small obtuse incline angle to the surface 21, the hard material, which does not pass through the holes 24, is gradually urged inwardly by the blade 20, as the blade chops the meat which has been urged against the inner surface 21 of the chopper plate 17.

The inner ends of each knife 51 terminates outwardly of the mouth 40*a* of the bone discharge passageway 40 thereby permitting all blades to clear the bone, gristle and sinews which have been urged inwardly sufficiently that they are disposed over or within the mouth 40*a*.

It will be remembered that the auger 15, when rotating, applies a very substantial forward pressure to all of the material within the housing 10 so as to urge that material against the inner surface 21 of the chopper plate 17. The softer material, such as meat and fat, is thus urged sufficiently through the holes 24 that the knives 51 progressively chop the meat into the ground material which is discharged from the outer surface 22 of the chopper plate 17.

When the meat grinder is operating, meat is fed through the grinder, against plate 17 and as the meat is ground, the hard particles, such as bone, gristle and sinews which are larger than holes 24 are accumulated in front of the knives 50 and are fed inwardly thereby eventually passing from the inner ends of knives 50 into the mouth 40*a* of passageway 40. Thereafter, the bone, sinews and gristle progressively move into passageway 40 being urged by the pressure differential through passageway 40 and into and through the exit passages 41. When the initial start up of the meat grinder takes place, the cork 36 should be installed on the end 35 of the tube 32 so as to prevent any discharge of the material until the tube 32, the passages 41 and the discharge passageway 40 have been filled with meat and bone. This accumulation of meat and bone in the tube 32 creates a sufficient back pressure to enable the meat grinder to function quite efficiently, from then on since, thereafter, the hard material is essentially the only material urged toward the center of plate 17 and under the hub 46 while the meat is chopped as it is urged by the forward pressure through the holes 24.

Because of the funnel shaped, frusto-conical configuration of the bone discharge passageway 40, there is no area within the passageway 40 which will require the bone fragments, sinew and the gristle to change their direction of movement, to an appreciable extent. Thus, there is a progressive urging of the hard material in generally an axial direction out through the discharge path defined by the passageway 40, the passages 41 and tube 32. The sharp fragments of bone, thus do not tend to arrest or cause excessive clogging of the entire discharge path and, indeed, slide smoothly with respect to each other since the material is progressively, gradually forced inwardly to a smaller cross-section, as it is progressively moved in the direction of axis $\alpha$. Furthermore, the tube 32, when it becomes filled with the hard material, provides sufficient back pressure on the exit passages 41 and the communicating conical shaped, discharge passageway 40 that there is only a gradual movement of the material along the tube 32 after the cork 36 has been removed.

If too much meat is passing through the discharge path, with the hard material, the clamp 37 can be effectively used to restrict the travel along the discharge passageway. The end portions of clamp, arms or members 37 rotatably receive screws 38, which are threadedly received by the end portions of one clamp arm 39 so that when the screws 38 are rotated in one direction the arms 39 are progressively moved toward each other to progressively flatten opposite portions of the tube 32 and thereby restrict the effective cross-section of tube 32.

Figure 6:
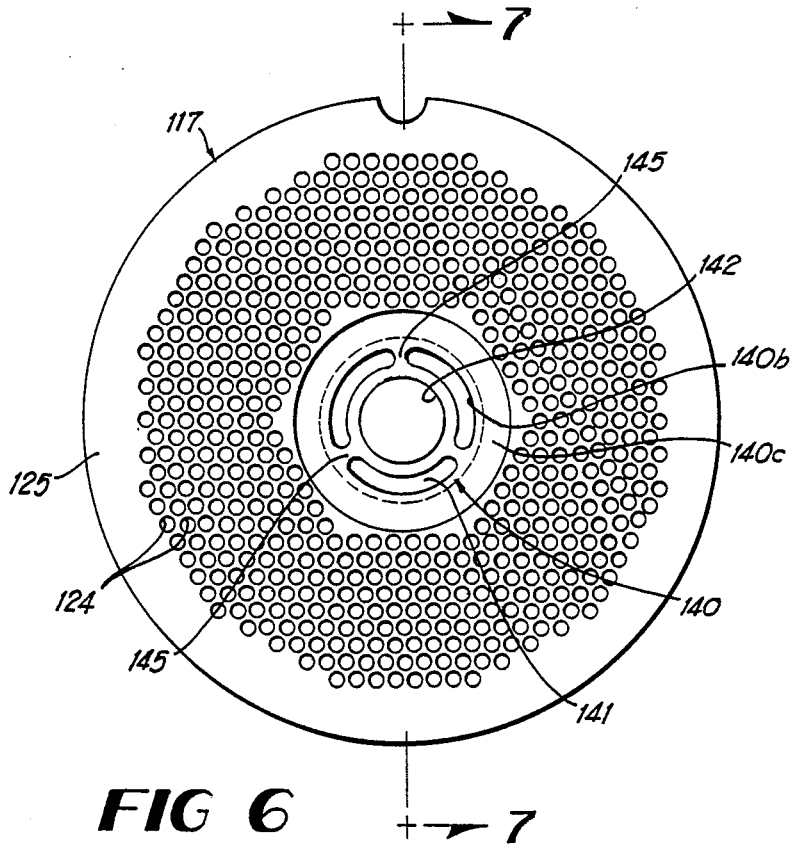
FIG. 6 is a fragmentary perspective view of a portion of an alternate embodiment of the chopper plate of the present invention.
Figure 7:
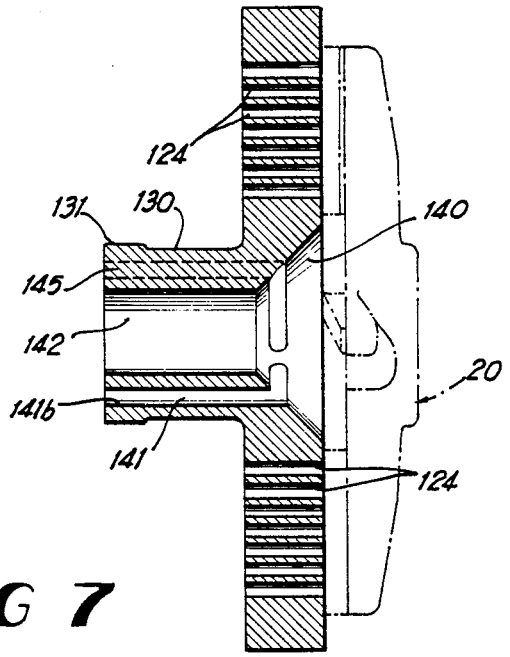

In FIG. 6 is a modified form of chopper plate 117 which has holes 124 through which the meat passes and a central hub 130 through which the hard material such as bone fragments, sinew and gristle is discharged all as in the preceeding embodiment. In this embodiments, however, the funnel shaped opening includes an outwardly tapered central bone discharge passageway 140 in the central portion of the plate 117, the wall or surface **140*b* which defines the frusto-conical passageway 140 protruding into the hub 130. The hub 130, which protrudes from the outer surface of the central portion of the plate 117, is a hollow tubular member which concentrically surrounds a central smaller journal sleeve 142. Flat radially extending vanes 145 arranged 120° from each other protrude outwardly from sleeve 142 and connect to the inner surface of the hub 130. Vanes 145 extend axially through the hub 130 inwardly to terminate at the discharge passageway 140. Thus, the vanes 145 define, therebetween, three circumferentially spaces, discharge channels or passages 141 which communicate with the relatively small discharge end portion 141*c* of the frusto-conical passageway 140 to receive material urged into the mouth 140*a* of passageway 140 and then through the passageway 140. The outer walls or surfaces 141*a* defining the passages 141 are concentric about sleeve 142 and merge into the conical surface 140*b* at exit end 140*c* of the passageway 140. The stub shaft or stud (not shown) protrudes through and is journalled by sleeve 132**.

Since the plate 117 operates in the same manner as the plate 17, no detailed description of its operators is deemed necessary.

It will be obvious to those skilled in the art that many variations may be made in the embodiments here chosen for the purpose of illustrating the present invention without departing from the scope thereof as defined by the appended claims.

We claim:

1. A process of separating bone from meat as the meat is being ground comprising:

(a) urging meat containing bone against the inner surface of a chopper plate having a plurality of small holes therein and an essentially unobstructed conical outwardly tapering passageway surrounding a shaft in its central portion;

(b) passing successive blades in a rotary path around the axis of said shaft and along said inner surface and over said small holes in said plate with the edge of the blades disposed angular to the radius of said axis for chopping meat urged into said small holes and separating said bone from said meat and directing substantially all of said bone inwardly toward said unobstructed inner end of said passageway;

(c) progressively passing said bone directly from said blades radially inwardly into and through the progressively narrowing path of said passageway;

(d) progressively passing the bone which has been passed through said passageway, from the smaller end of said passageway directly in an axial path adjacent to said shaft outwardly away from said passageway and along the outer periphery of said shaft; and (e) thereafter, discharging said bone from said axial path.

2. Process for separating bone from meat when the meat is being ground, comprising:

(a) urging the meat containing bones against the inner surface of a chopper plate having a plurality of small holes therein, so that the meat progressively protrudes through said small holes;

(b) passing successive blades in a rotary path around said axis and over said inner face for progressively chopping those portions of the meat which protrude through and into said holes and separating the bone in such meat therefrom;

(c) directing the bone which is separated from the meat without appreciably impeding its movement inwardly toward said axis of rotation of said blades;

(d) disposing a progressively narrowing surface around said axis and within the central portion of said plate for providing a passageway for accumulating therein said bone;

(e) progressively moving said bone toward the narrowmost portion of said passageway;

(f) discharging the bone from the narrowmost portion of said passageway in essentially a path parallel to said axis and into one end of a tube; and (g) at least partially confining the travel of said bone in said tube to regulate the back pressure on the bone in said tube and in said passageway.

3. The process defined in claim 2 wherein the step of confining the travel of said bone in said tube includes installing a plug in the other end of said tube until bone has accumulated throughout substantially the length of said tube.

4. The process defined in claim 2 wherein the step of confining the travel of said bone includes restricting the effective cross-sectional area of said tube adjacent to the other end of said tube.

5. The process defined in claim 2 wherein regulating the back pressure on said bone includes flexing said tube for varying the effective cross-sectional area of said tube.

6. Process for disposing of bone fragments which are separated from meat in a meat grinder as the meat is fed in a direction through the meat grinder and out of one end of the meat grinder as ground meat, comprising the steps of:

(a) progressively urging inwardly inclined successive blades against said bone fragments for directing substantially all of the bone fragments, which are separated from the meat, toward the central portion of the meat grinder;

(b) progressively directing the inwardly directed bone fragments directly over the rim of the open mouth of a progressively narrowing passageway which extends in the said direction;

(c) directing the bone fragments from the narrowmost end portion of said passageway directly into a discharge passage which extends in said direction and away from said passageway;

(d) channeling said bone fragments emerging from said passageway in a channel leading away from the passage for shielding the channeled bone fragments from said ground meat which emerges from said meat grinder; and (e) providing a back pressure on said bone fragments by restricting said channel.

7. The process defined in claim 6 wherein the step of channeling said bone fragments in a channel includes passing said bone fragments through a flexible tube and deforming the shape of said tube to restrict the flow of the channeled bone fragments for providing a back pressure externally of said meat grinder on said bone fragments.

8. The process defined in claim 6 including initially blocking the channeled bone fragments at the end portion of the channel so as to accumulate bone fragments externally of said meat grinder, sufficient to provide a back pressure within said meat grinder against the movement of said bone fragments in said passageway.

9. The process defined in claim 6 wherein the channeling of said bone fragments permits the bone fragments to flow freely along said channel until a prescribed amount of bone fragments has been accumulated and thereafter regulating the flow of the bone fragments so as to provide a back pressure on the bone fragments within said passageway.

* * * * *